US009732496B1

(12) United States Patent
Newman et al.

(10) Patent No.: US 9,732,496 B1
(45) Date of Patent: Aug. 15, 2017

(54) SORTING AND SIFTING METHODS AND APPARATUS, AND LOADER ATTACHMENTS AND METHODS

(71) Applicant: NewMax Inc., Colville, WA (US)

(72) Inventors: Christopher Martin Newman, Spokane Valley, WA (US); Ronald Joseph Maestas, Colville, WA (US)

(73) Assignee: NewMax Inc., Colville, WA (US)

( * ) Notice: Subject to any disclaimer, the term of this patent is extended or adjusted under 35 U.S.C. 154(b) by 0 days.

(21) Appl. No.: 15/081,792

(22) Filed: Mar. 25, 2016

Related U.S. Application Data

(60) Provisional application No. 62/141,792, filed on Apr. 1, 2015.

(51) Int. Cl.

| | |
|---|---|
| ***B07B 1/49*** | (2006.01) |
| ***E02F 7/06*** | (2006.01) |
| ***B07B 1/46*** | (2006.01) |
| ***E02F 3/40*** | (2006.01) |

(52) U.S. Cl.
CPC ..... *E02F 7/06* (2013.01); *B07B 1/4618* (2013.01); *E02F 3/40* (2013.01)

(58) Field of Classification Search
CPC ..... B07B 1/46
USPC ..... 209/420, 421, 405; 37/406
See application file for complete search history.

(56) References Cited

U.S. PATENT DOCUMENTS

| | | | | |
|---|---|---|---|---|
| 2,371,549 | A * | 3/1945 | Sembler | A01D 76/006 299/36.1 |
| 3,440,744 | A | 4/1969 | Smith | |
| 3,914,884 | A | 10/1975 | Guinot | |
| 3,935,953 | A | 2/1976 | Stedman | |
| 4,056,205 | A * | 11/1977 | Etzler, IV | A01D 87/127 37/403 |
| 4,125,952 | A * | 11/1978 | Jennings | A01D 87/0053 37/405 |
| 4,329,103 | A * | 5/1982 | Miller | B66F 9/061 172/253 |
| 4,903,418 | A | 2/1990 | Loudon | |
| 5,160,034 | A * | 11/1992 | Potter | B07B 1/005 171/135 |
| 5,515,625 | A * | 5/1996 | Keigley | E02F 5/30 172/253 |
| 6,098,320 | A * | 8/2000 | Wass | A01D 87/00 37/406 |
| 6,481,949 | B1 | 11/2002 | Cullen | |
| 2015/0047862 | A1 * | 2/2015 | Hull | A01G 17/16 171/1 |

* cited by examiner

*Primary Examiner* — Terrell Matthews
(74) *Attorney, Agent, or Firm* — Deepak Malhotra; Malhotra Law Firm, PLLC

(57) ABSTRACT

An attachment configured to be captured and lifted by a bucket of a vehicle includes a back end proximate the bucket, in operation; a left side; a right side; a front end distal from the bucket, the front end defining a bottom surface; connection means for receiving a forward edge of the bucket, wherein the bucket can engage and lift the attachment; and means defining a material handling area between the left side, right side, front end, and back end, the material handling area including apertures for sifting, wherein material rolls up into the material handling area when the attachment moves forward so that material can be sifted in the sifting area.

18 Claims, 15 Drawing Sheets

SORTING AND SIFTING METHODS AND APPARATUS, AND LOADER ATTACHMENTS AND METHODS

CROSS REFERENCE TO RELATED APPLICATION

This application claims priority to U.S. Provisional Patent Application Ser. No. 62/141,792, which was filed Apr. 1, 2015, and is incorporated herein by reference.

TECHNICAL FIELD

The technical field comprises vehicles including loader buckets, such as front end loaders. The technical field also comprises attachments to loader buckets. The technical field also comprises sifting and sorting apparatus and methods.

BACKGROUND

There is wide spread ownership of vehicles including buckets, such as front end loaders, as they are relatively inexpensive. These vehicles, while useful for their intended purpose, are limited in their functions.

Various types of attachments are known in the art to allow such vehicles to perform additional functions. For example, U.S. Pat. No. 3,440,744 (incorporated herein by reference) discloses a blade attachment.

U.S. Pat. No. 3,914,884 (incorporated herein by reference) describes a hydraulic shovel scoop.

U.S. Pat. No. 3,935,953 (incorporated herein by reference) discloses a loader attachment used for digging and carrying a load, or for moving a load form one location to another.

U.S. Pat. No. 4,903,418 (incorporated herein by reference) discloses a hydraulic loader attachment for removing and transporting trees, bushes, or other plants. The attachment is a digging attachment with a concave scoop.

U.S. Pat. No. 6,481,949 (incorporated herein by reference) discloses a crane attachment.

U.S. Pat. No. 6,098,320 (incorporated herein by reference) discloses an attachment including forks and grapple for digging, dislodging and lifting materials such as rocks and stumps.

SUMMARY

Some embodiments provide a sifter-sorter attachment configured to be captured and lifted by a bucket of a vehicle, the attachment including a back end, proximate the bucket in operation; a left side defined by a left end piece; a right side defined by a right end piece; the left and right end pieces including aligned slots for receiving a forward edge of the bucket, wherein the bucket can engage and lift the attachment using the slots; a front end, distal from the bucket in operation; a plurality of spaced apart tines distributed between the left end piece and right end piece; a lateral attachment bar connected to the left end piece, tines, and right end piece; and the tines, left end piece, and right end piece including respective lower surfaces, with which the attachment can rest on a surface prior to being engaged by the bucket; the tines, left end piece, and right end piece including respective upper surfaces defining a curved material handling area in the general shape of a trough.

Other embodiments provide an attachment configured to be captured and lifted by a bucket of a vehicle, the attachment comprising a back end proximate the bucket, in operation; a left side; a right side; a front end distal from the bucket, the front end defining a bottom surface; connection means for receiving a forward edge of the bucket, wherein the bucket can engage and lift the attachment; and means defining a material handling area between the left side, right side, front end, and back end, the material handling area including apertures for sifting, wherein material rolls up into the material handling area when the attachment moves forward so that material can be sifted in the sifting area.

Other embodiments provide a material handling method comprising providing a sifter-sorter attachment configured to be captured and lifted by a bucket of a vehicle, the attachment having a back end proximate the bucket, in operation; a left side; a right side; a front end distal from the bucket, the front end defining a bottom surface; slots for receiving a forward edge of the bucket; a material handling area between the left side, right side, front end, and back end, the material handling area including apertures for sifting; engaging the front edge of a bucket of a front end loader into the slots of the sifter-sorter attachment; moving the front end loader forward to scoop up material into the material handling area of the attachment, wherein material rolls up then down into the material handling area when the attachment moves forward; and lifting the bucket to lift the attachment, so that material can be sifted in the sifting area, with smaller material falling through the apertures and larger material remaining

DETAILED DESCRIPTION OF THE ILLUSTRATED EMBODIMENTS

Various prior art devices for providing a sifting-sorting capability required the bucket and the sorter to be made as one unit. Such prior art devices have the expense and cost of designing and fabricating a complete and combined bucket and sorter. Such devices also require providing the complete assembly and having the mating or attaching hardware on the back of the complete assembly to be able to attach the assembly to the machine. Such prior art devices also require the removal of the bucket and the installation of the separate assembly. It can be difficult to align the separate assembly and may take longer to attach and secure the assembly to the machine.

In addition, the entire assembly must be sized to allow it to properly fit and be used by the machine. While the prior art devices may be adequate for sorting and handling material, they do not take advantage of the standard bucket's availability. The prior art has the added expense of duplicating the material bucket carry feature. Further, prior art methods require the operator to release the bucket and add the separate attachment to the bucket in order to accomplish the work.

Prior art methods require the operator to purchase separate attachments.

Figure 3:
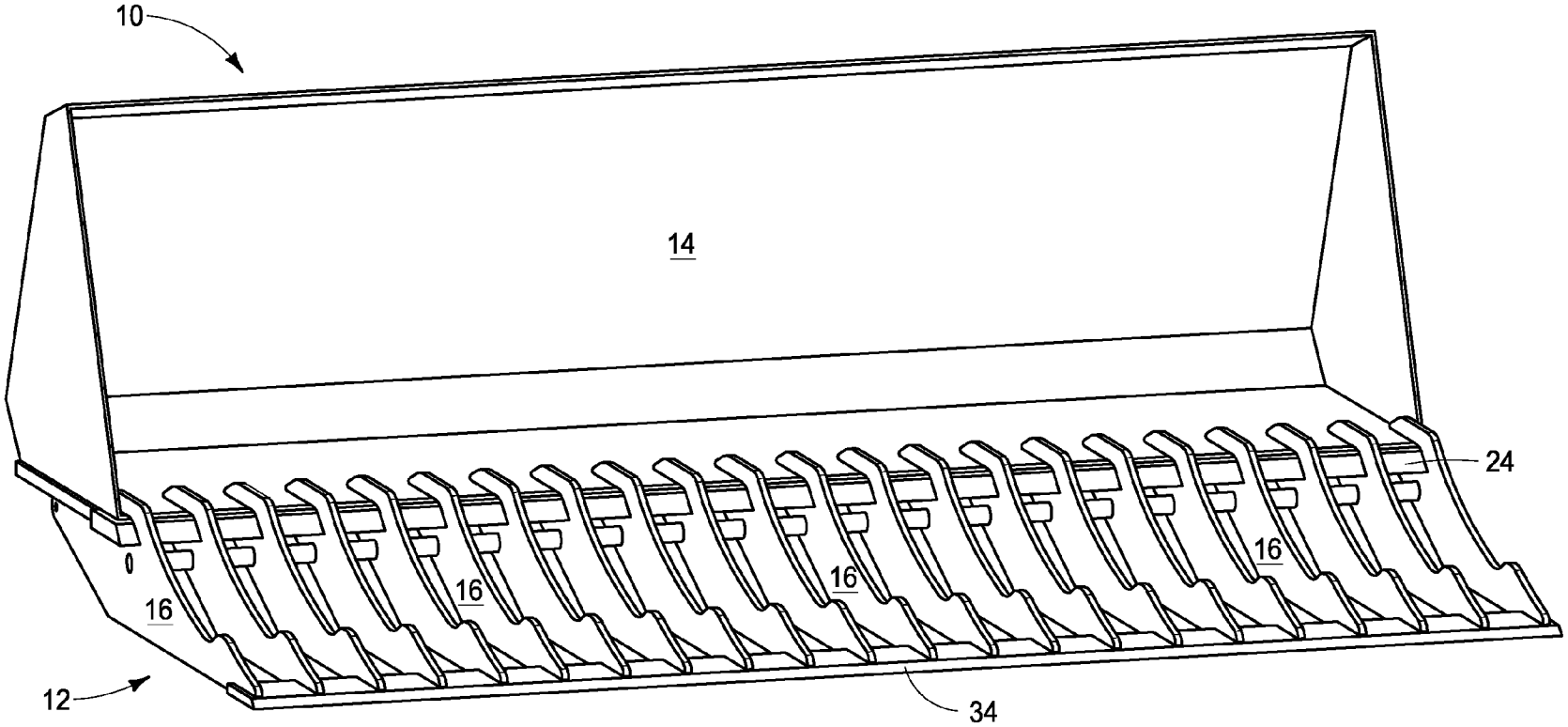
FIG. 3 is a perspective view of a bucket of a loader machine or vehicle, and a sifter-sorter installed on the bucket, in accordance with various embodiments.

The various figures show systems 10 (see FIG. 3) for sifting and sorting including sifter-sorters or sifter-sorter attachments 12 in accordance with various embodiments. The term sifter-sorter, as used herein, including in the appended claims is intended to encompass devices capable of either sifting or sorting materials.

Various embodiments provide systems and methods for the properly, safely, and quickly adding a material sifter-sorter 12 to an existing bucket 14 (see FIG. 3) of a loader vehicle or machine (not shown, see the above-incorporated patents for examples) to increase the utility and capability of the bucket 14. Various embodiments provide methods and systems to eliminate the need to take off an existing attachment (not shown) in order to add this capability. Various embodiments provide a commercially viable method for adding sifting and sorting capability to the existing machine (not shown) with minimal impact on cost and time, and to provide a design by which the width can be made to easily match the current machine's size and rating to enable the sifter-sorter to be added without impacting the machine.

Figure 1:
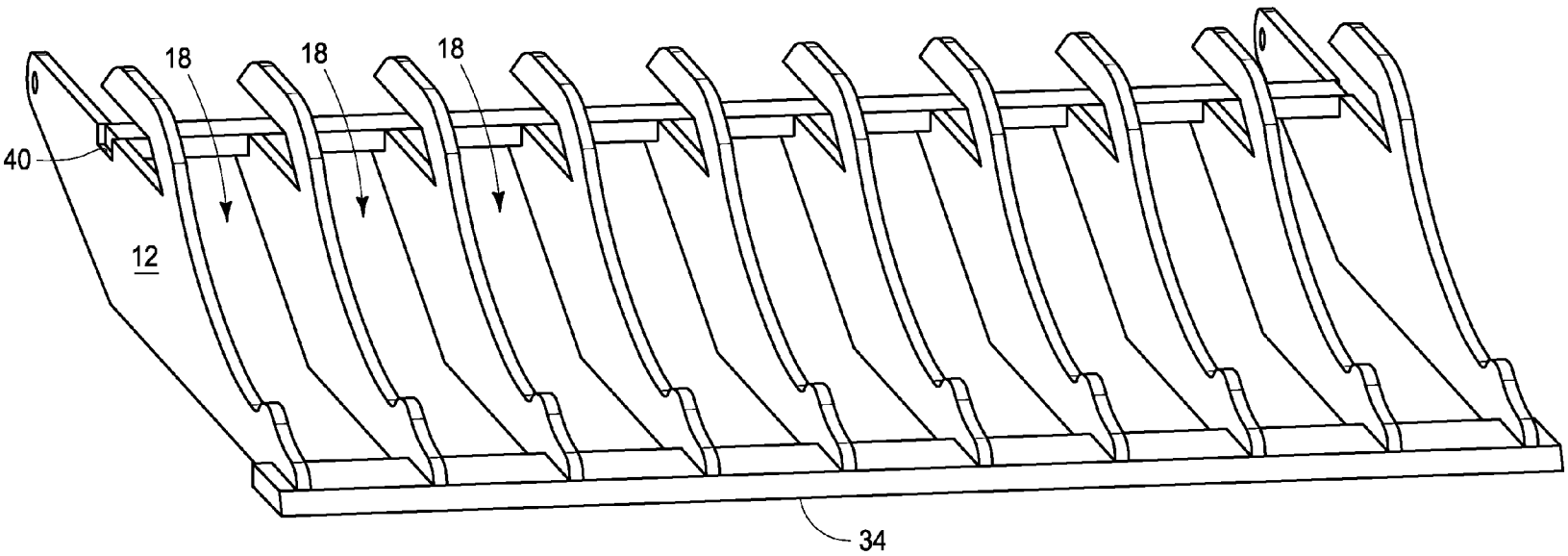
FIG. 1 is a perspective view of an attachment, ready to be captured by a bucket of a loader vehicle, for sifting or sorting, in accordance with various embodiments.

In various embodiments, the sifter-sorter 12 is configured so that material (e.g., including dirt and wood or rocks, or dirt and other items) which has been picked up by the sifter-sorter 12 rolls towards a holding area 16 (see FIG. 3) and to allow dirt to sift out the open bottom 18 (see FIG. 1) of the sifter-sorter 12 before the rest of the material progresses into the bucket 14.

Figure 2:
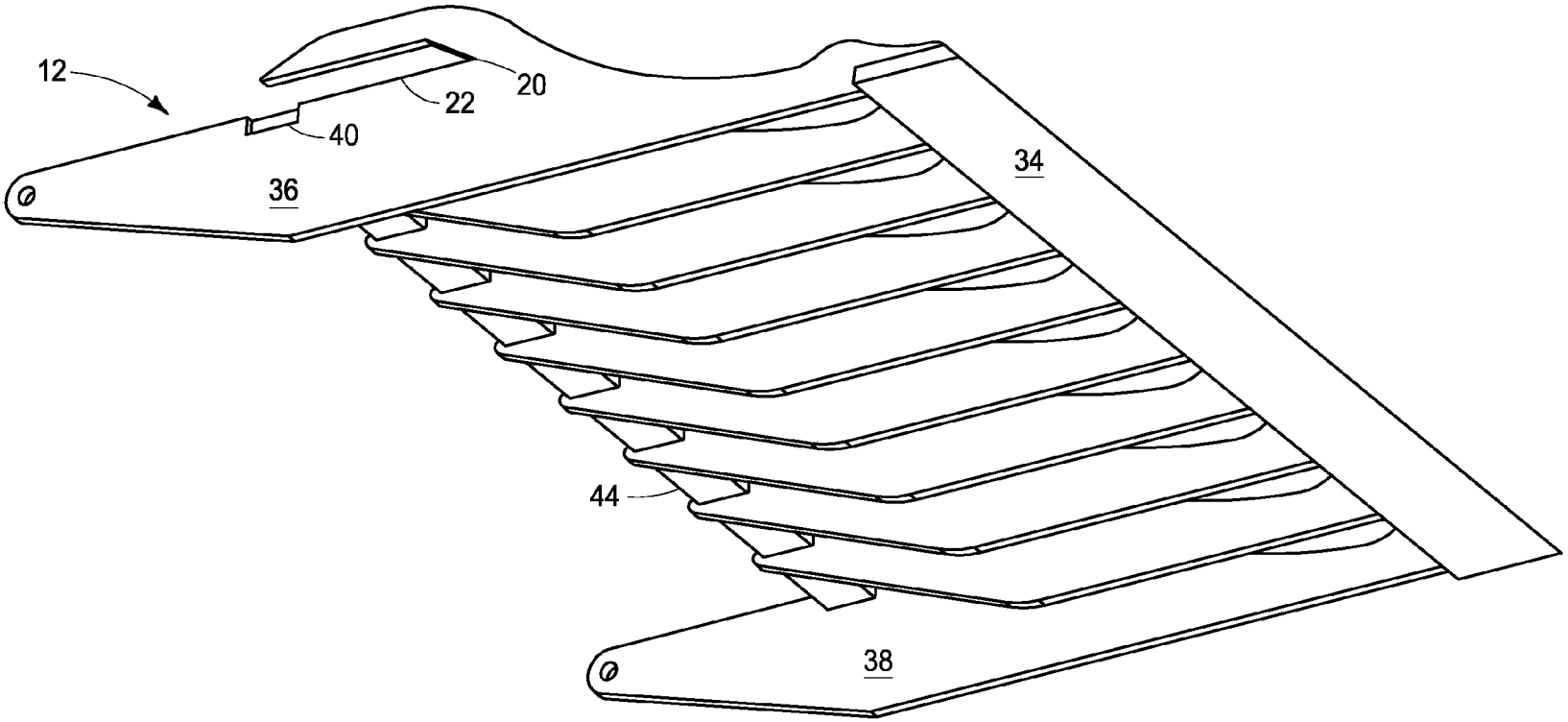
FIG. 2 is a perspective view of the attachment of FIG. 1, from a different angle.

In various embodiments the sifter-sorter 12 is configured to be easily installed or captured by an existing bucket 14 and retained by the bucket 14. In various embodiments, the sifter-sorter 12 has a wedge shaped capture area 20 (see FIG. 2) including slots 22, allowing various sizes of bucket front edges 24 (see FIG. 3) to fit tightly into the capture area 20 of the sifter-sorter 12.

More particularly, in various embodiments, the sifter-sorter 12 includes (see FIG. 2) left and right end pieces 36 and 38 each including slots 22 that together define the capture area 20.

Various embodiments provide for collecting of material that has been captured to the holding area 16 (see FIG. 3) of the sifter-sorter 12 so that it does not fall out prior to the load being deposited in a desired place.

Figure 4:
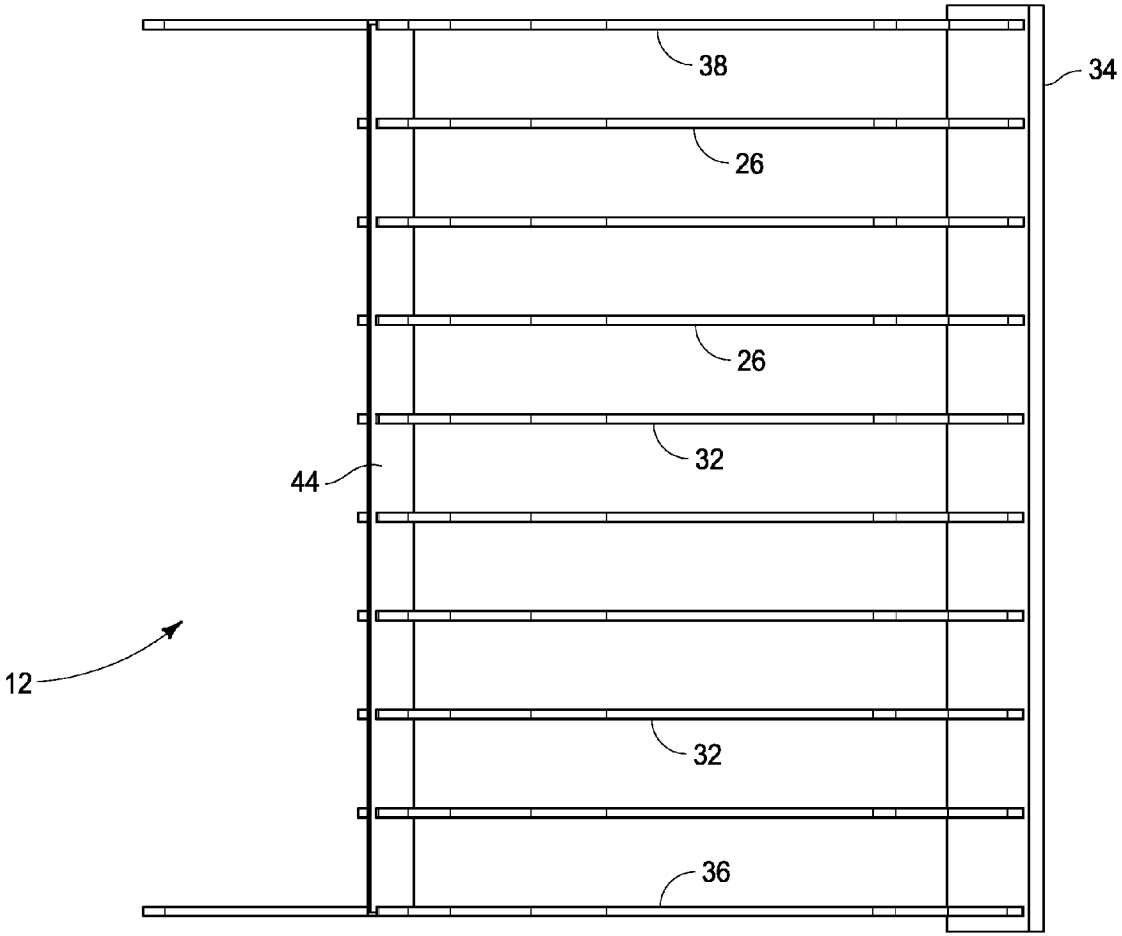
FIG. 4 is a top view of the sifter-sorter of FIG. 1, in accordance with various embodiments.
Figure 5:
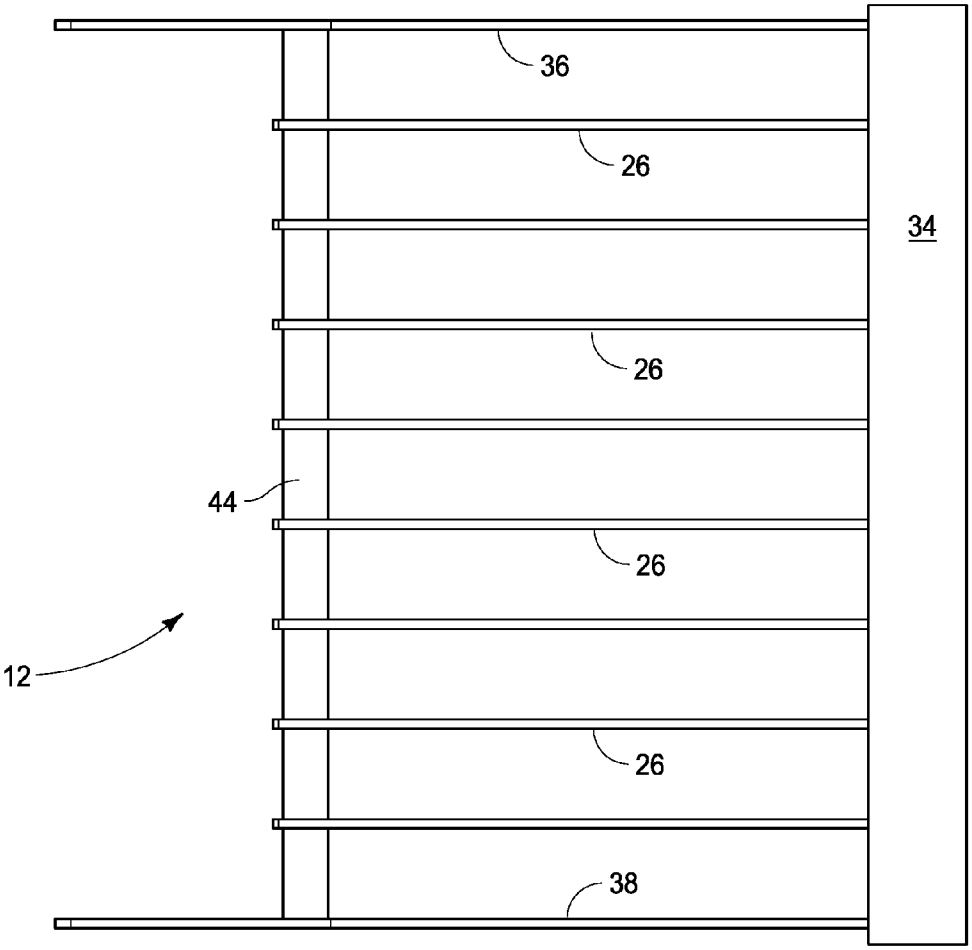
FIG. 5 is a bottom view of the sifter-sorter of FIG. 1, in accordance with various embodiments.
Figure 8:
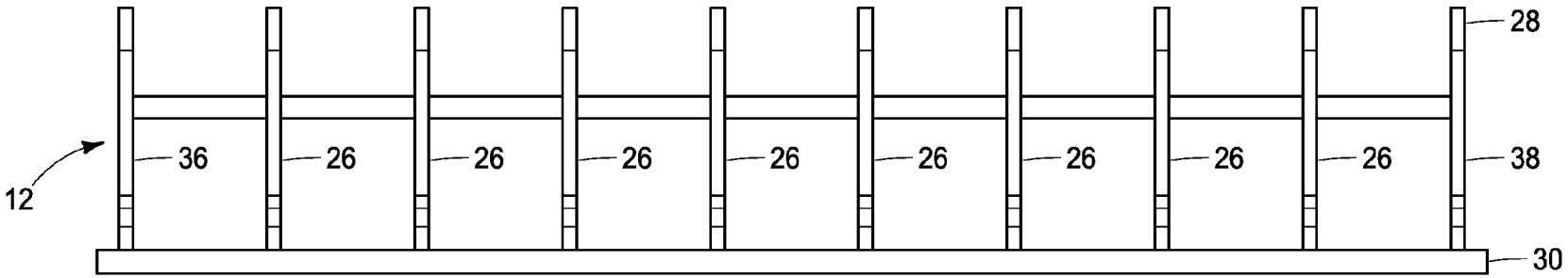
FIG. 8 is a top view of the sifter-sorter of FIG. 1, in accordance with various embodiments.
Figure 9:
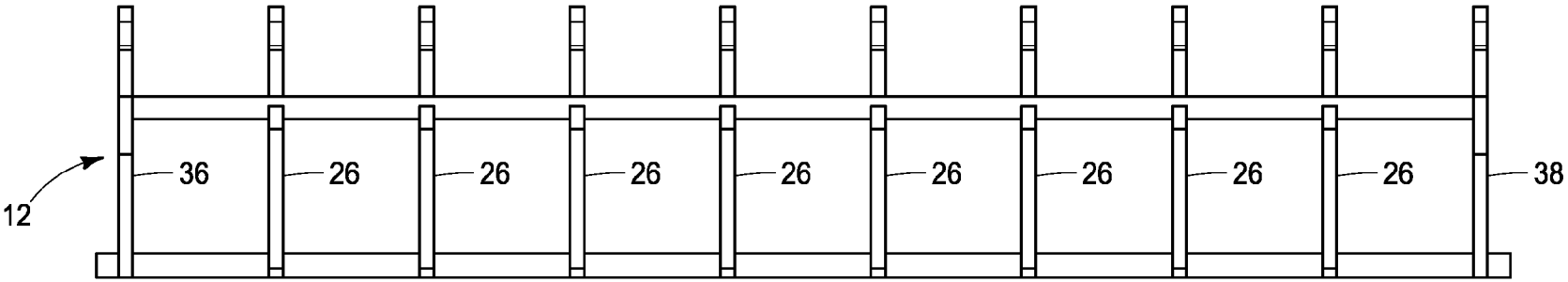
FIG. 9 is a bottom view of the sifter-sorter of FIG. 1, in accordance with various embodiments.
Figure 10:
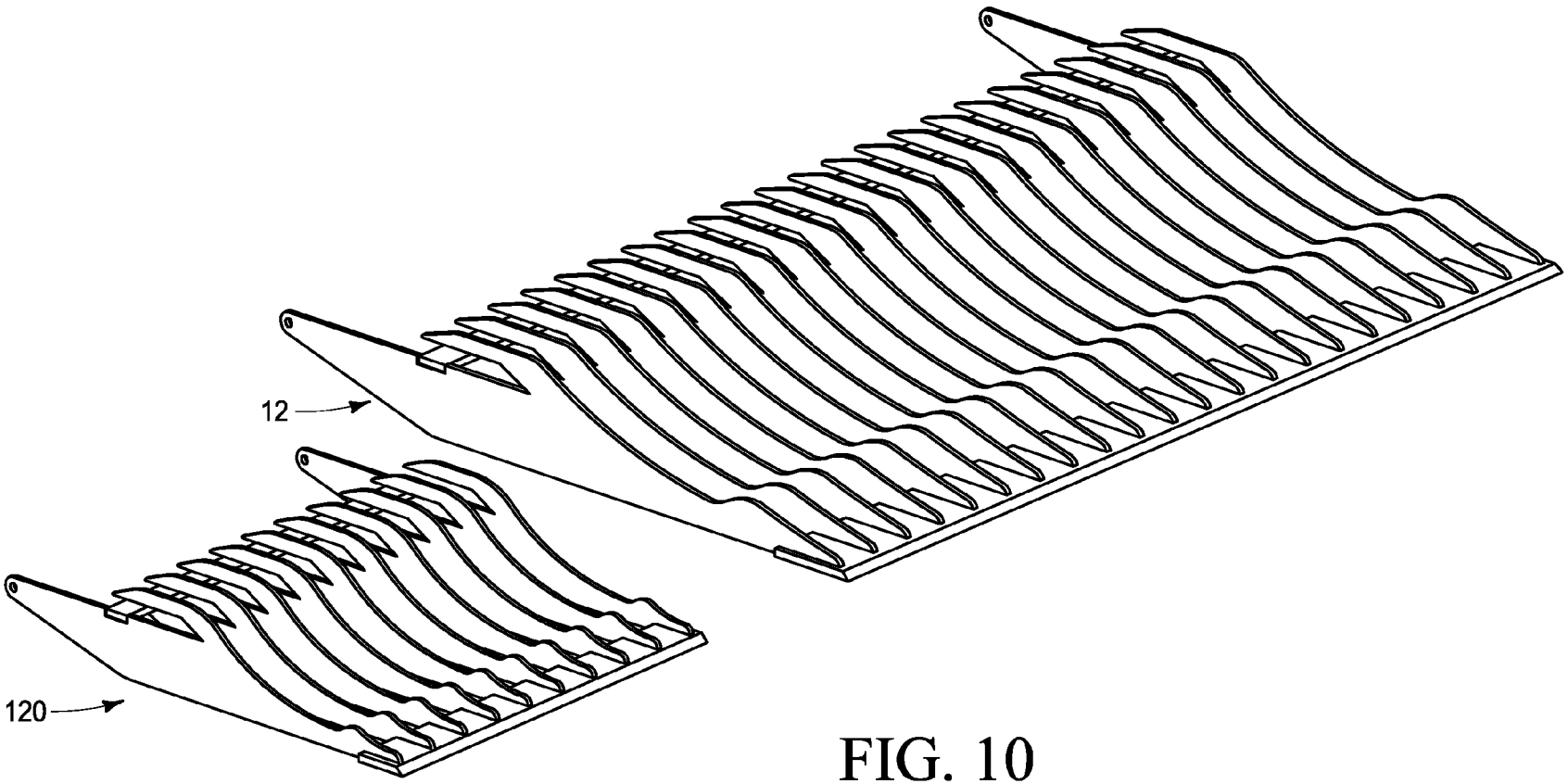
FIG. 10 is a perspective view of attachments of different sizes, ready to be captured by respective buckets of loader vehicles, for sifting or sorting, in accordance with various embodiments.

In various embodiments the sifter-sorter 12 includes, to reduce potential damage to the bucket 14, distributed tines 26 (see FIGS. 4, 8 and 9) across the top 28 and bottom 30 (see FIG. 8) of the sifter-sorter 12 to distribute the pressure and load across the width and length of the bucket 14.

In various embodiments the sifter-sorter 12 defines a cradle area 32 (FIG. 4) in front of the bucket 14, to pick up longer items such as logs, pipes, branches and other material, and carry them to a desired location.

In various embodiments the sifter-sorter 12 has a front facing cutting edge 34 (FIGS. 1-4) that ties the fronts of the tines 26 together so as to avoid the possibility of bending of the fronts of the tines 26 when the sifter-sorter 12 is being used. The front cutting edge 34 is used, in some embodiments, as a material grader to smooth an area that has been cleaned.

Figure 7:
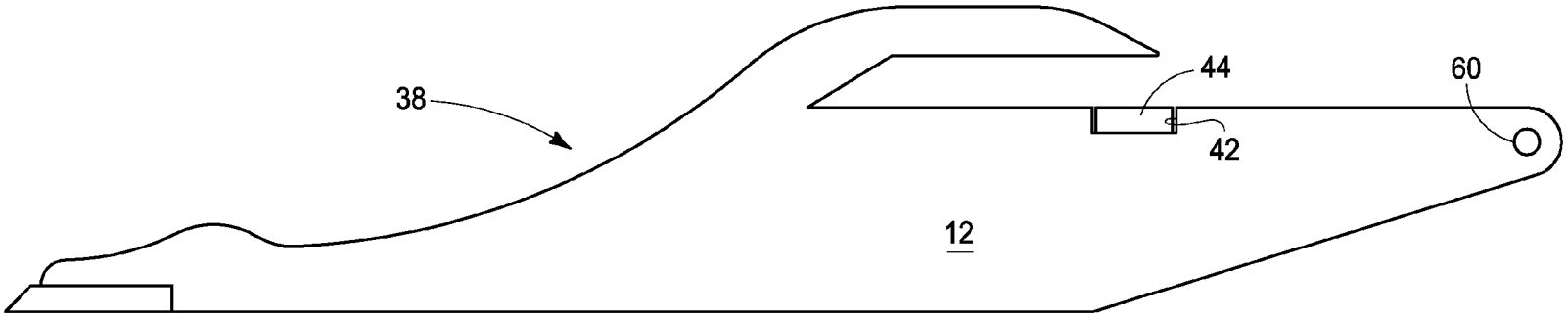
FIG. 7 is a right view of the sifter-sorter of FIG. 1, in accordance with various embodiments.

Further, in various embodiments, the end pieces 36 and 38 include respective notches 40 (see FIGS. 1 and 2) and 42 (see FIG. 7) and the sifter-sorter 12 includes a rear brace member or bar 44 (see FIG. 7) received in the notches 40 and 42. The tines 26 are spaced apart by and supported by the brace member 44, along with the cutting edge 34.

In various embodiments, the sifter-sorter 12 has adequate support at the top and bottom of the bucket 14 to reduce damage to the bucket 14 as it is being used.

Various embodiment provide different spacing of the tines 26, selected based on the size of materials to be handled with the sifter-sorter 12, to enable a more productive sorting or sifting action.

In various embodiments, an operator can utilize the existing bucket 14 of a loader machine and quickly add the sifter-sorter 12 to his operation to be able to quickly clean and clear rock and debris without having to obtain a complete attachment and mount and install it on the machine. In various embodiments, the sifter-sorter 12 attachment is designed so as to distribute the load and pressure exerted by the use of the attachment for scraping and picking up rocks.

Figure 12:
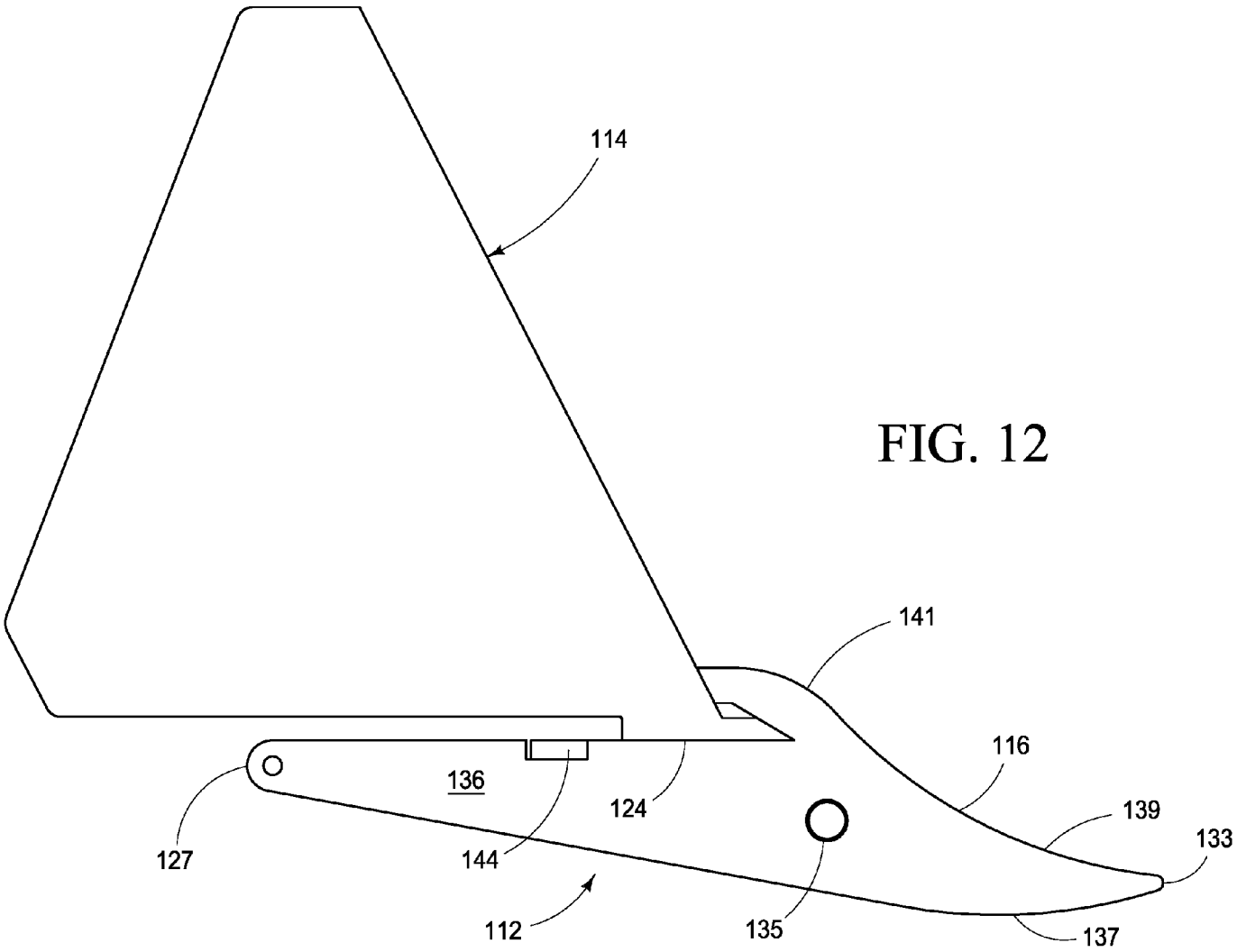
FIG. 12 is a side view of a bucket of a loader machine or vehicle, and a sifter-sorter installed on the bucket, in accordance with alternative embodiments.
Figure 13:
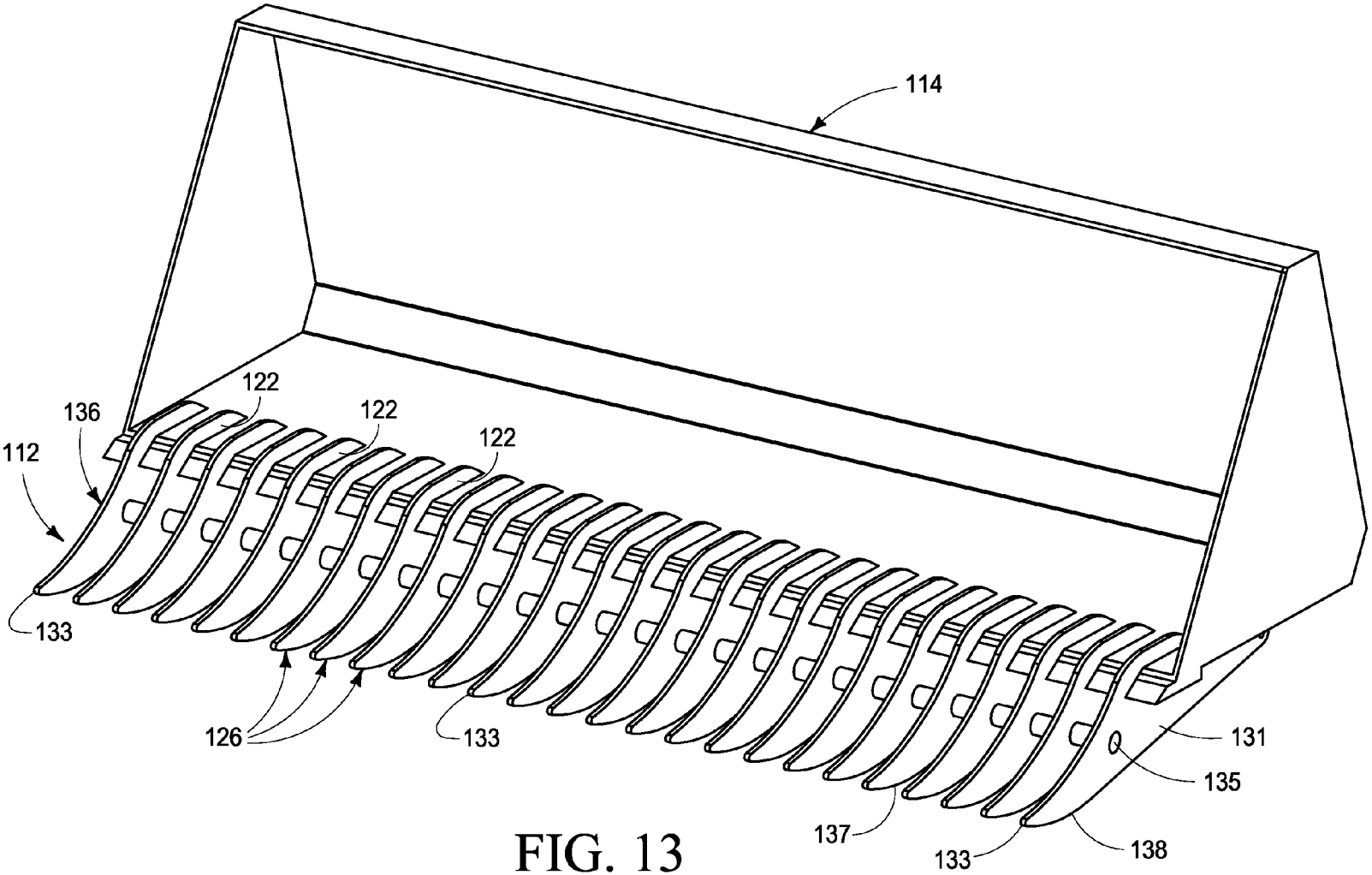
FIG. 13 is a perspective view of the bucket and the sifter-sorter of FIG. 12.
Figure 14:
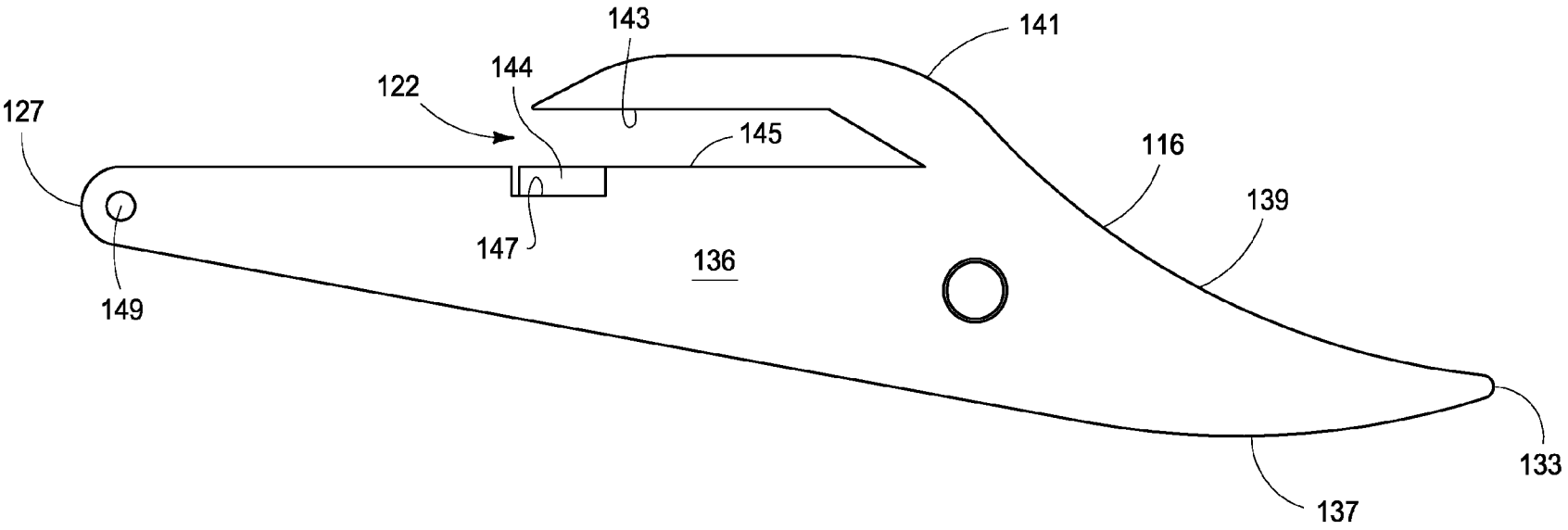
FIG. 14 is a side view of the sifter-sorter of FIG. 12.
Figure 15:
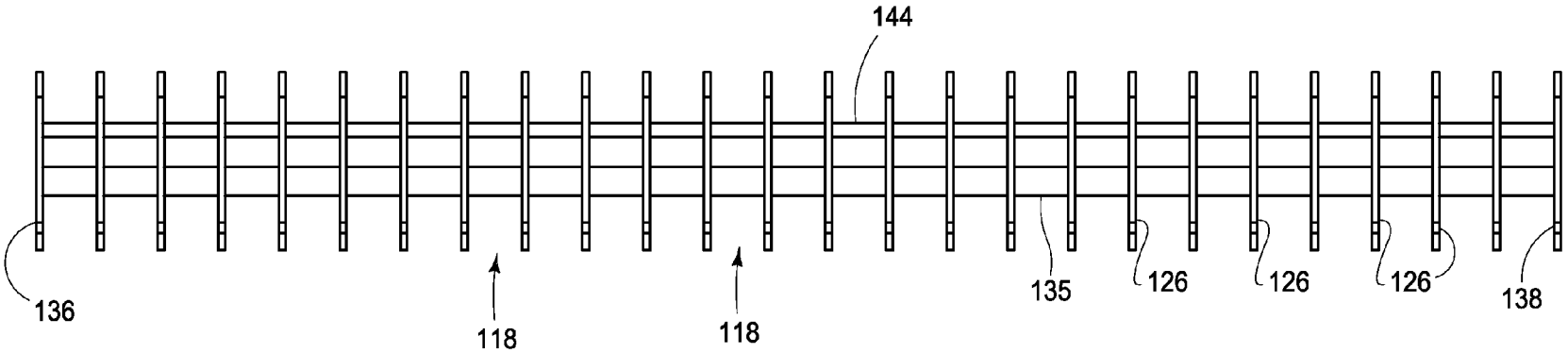
FIG. 15 is a front view of the sifter-sorter of FIG. 12.

Various embodiments provide methods and systems for easily picking up rocks and small debris using a standard equipment bucket 14 using a material sifting-sorting attachment that is easily added to the bucket 14. Various embodiments provide systems and methods for easily positioning an attachment, in this case the sifter-sorter 12, to align with a bucket 14. In various embodiments, a material sifter-sorter 12 is added to a standard, or custom, bucket 14 in a short period of time with very little effort. In various embodiments, a sifter-sorter 12 that can extract material from dirt and debris is added to bucket 14, and allows the material to roll up into a retaining area of the bucket 14. In various embodiments, the sifter-sorter can be sized to fit almost any size bucket 14 or horsepower of almost any machine. See, for example, FIG. 12 where sifter-sorter 120 has less width and length than sifter-sorter 12. The design provides protection of the bucket 14 with enhanced bracing that spreads the load and torque across the entire bucket area.

Various embodiments allow an operator to avoid removal an existing bucket 14 in order to clear land and areas that have rocks and small debris. Various embodiments allow easy installation and self-alignment of the sifter-sorter 12 to the bucket 14. In various embodiments, the sifter-sorter 12 includes a front edge cutting blade to cut through surface material. The cutting blade has a sloped front lip to allow material to roll up onto the sifter-sorter 12 as the sifter-sorter 12 is pushed forward along the ground. As the material passes along the top of the sifter-sorter 12, the dirt separates from rock and debris and falls through prior to entering the bucket 14. In various embodiments, the cradle area 32 in front of the bucket 14 can be used to carry longer items such as trees, limbs and pipes and poles. In various embodiments, the sifter-sorter 12 has a spacing between tines 26 that allows dirt to sift through and that captures the larger items such and rock and debris. In various embodiments, the wedge area 20 (FIG. 2), at the rear of the sifter-sorter 12 captures and distributes the weight and load to avoid damage to the bucket 14. In various embodiments, the wedge interface 20 adapts to various bucket lip geometries. In various embodiments, the sifter-sorter 12 is built to withstand heavy use.

In various embodiments, the sifter-sorter 12 is made of metal such as the type of metal used to manufacture buckets of front end loaders. The metal may be steel or an alloy, for example. Any kind of steel can be employed. In some embodiments, the sifter-sorter 12 is made of any metal or other material having sufficient strength and rigidity to lift and move the materials for which it is intended to be used.

In various embodiments, the sifter-sorter 12 is fastened using a quick release chain or is bolted or welded into place. For example, in some embodiments, a hook and tension chain is used to bind the sifter-sorter 12 to the back of a bucket 14. In some embodiments, the sifter-sorter 12 can be temporarily held in place on the bucket 14 using gravity, friction, or both gravity and friction, without any additional binding.

In some embodiments, the sifter-sorter 12 or some other attachment is attached to the bucket 14 by a series of chain and binder with a grab hook that hooks over the top edge of the bucket.

In some embodiments, the sifter-sorter 12 or some other attachment is attached to the bucket 14 by a series of chain and eye bolts with a grab hook that hooks over the top edge of the bucket.

In some embodiments, the sifter-sorter 12 or some other attachment is attached to the bucket 14 by a series of chain and eye bolts, and weld on brackets.

In some embodiments, the sifter-sorter 12 or some other attachment is welded on to the bucket 14 as a permanent attachment.

In some embodiments, the sifter-sorter 12 or some other attachment is attached to the bucket 14 with a welded chain hook and a series of chain and binder.

Figure 6:
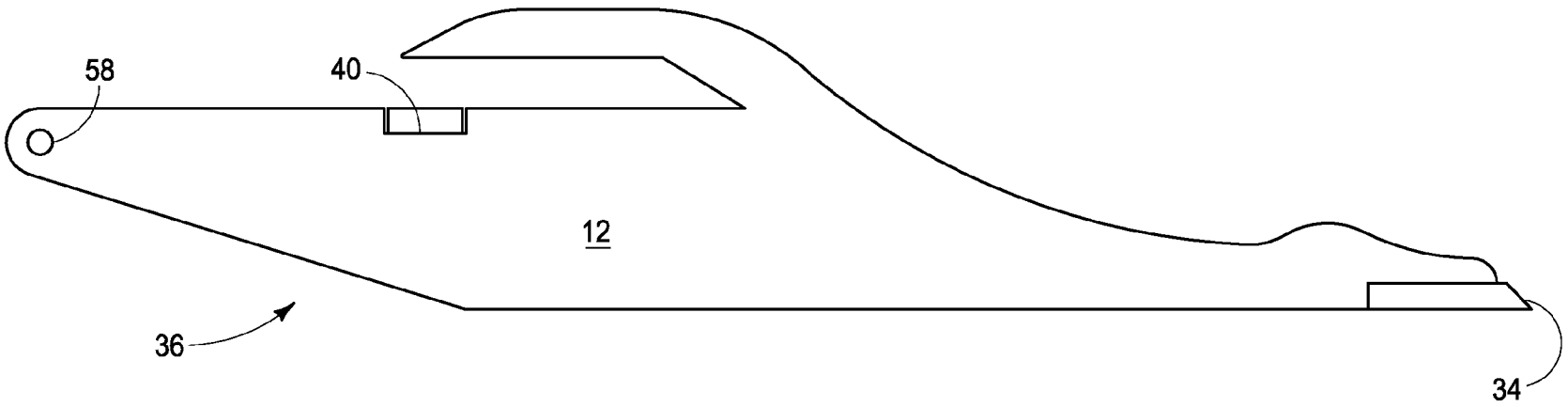
FIG. 6 is a left view of the sifter-sorter of FIG. 1, in accordance with various embodiments.
Figure 11:
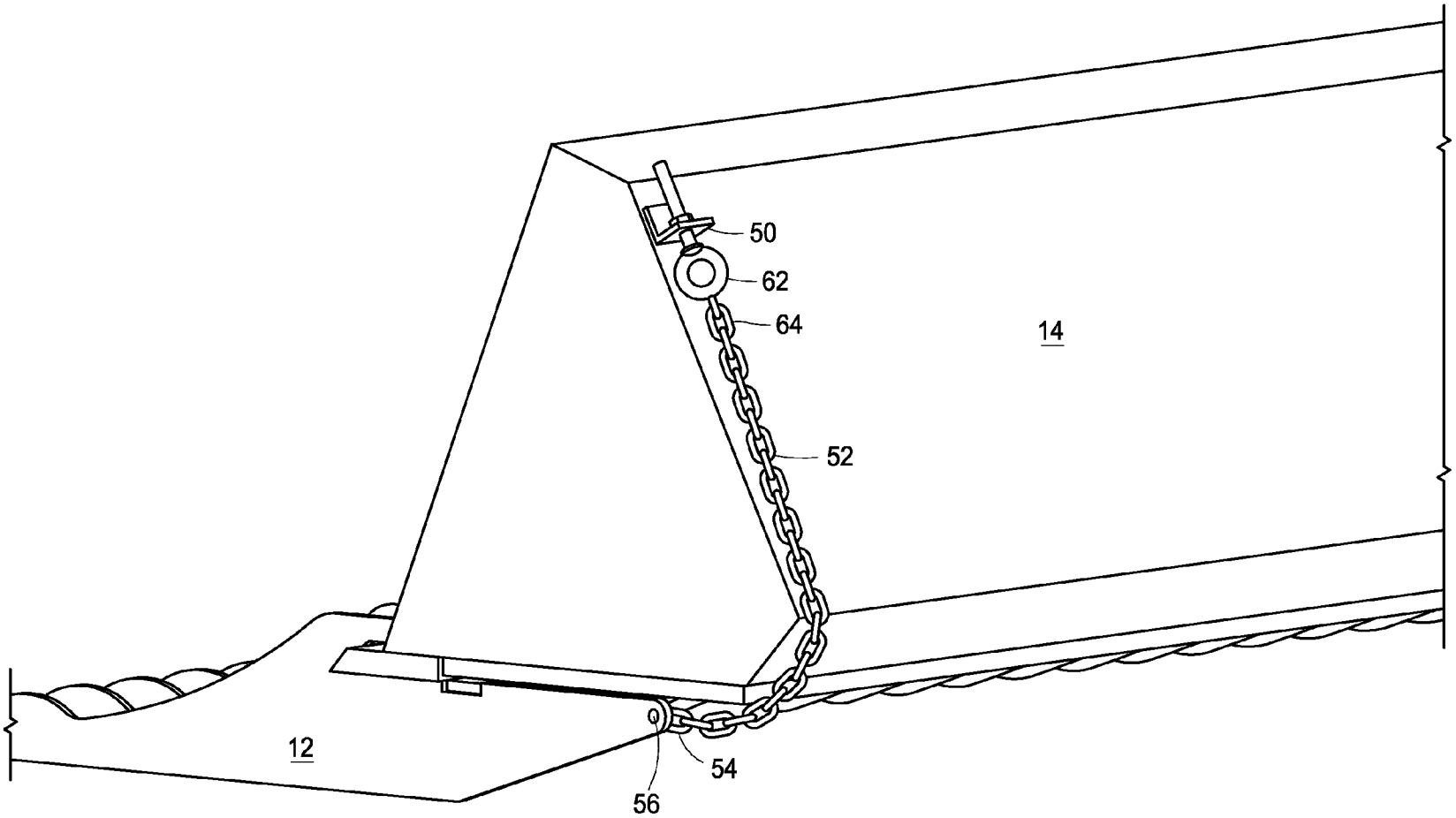
FIG. 11 is a perspective view that shows one possible structure for attaching an attachment to a bucket.

In some embodiments, the sifter-sorter 12 or some other attachment is attached to the bucket 14 as shown in FIG. 11. In these embodiments, a bracket 50 is welded on to the back of the bucket 14. A chain 52 has one end 54 attached to the sifter-sorter 12 by a pin 56 that passes through apertures 58 and 60 (see FIGS. 6 and 7) on either side of the sifter-sorter 12. The pin 56 also passes through a link at the end 54 of the chain or otherwise captures the end 54 of the chain. An eye bolt 62 attaches a link at the other end 64 of the chain 52 to the bracket 50. In some embodiments, the eye bolt 62 includes a threaded shaft that can be tightened to the bracket with a nut. While FIG. 11 shows one side of the bucket and attachment, a chain, bracket, and eye bolt are similarly used on the other side of the bucket and attachment.

In various embodiments, the sifter-sorter 12 has a tine bottom surface dimension that keeps the bucket 14 up off of top soil.

In various embodiments, the sifter-sorter 12 has a raised forward hump that prevents material from sliding forward and out of the bucket 14 or sifter-sorter 12. The raised forward hump still allows the captured rock and debris to be released when the bucket 14 is rotated forward to be dumped.

In some embodiments, the sifter-sorter 12 is manufactured using the following process:

1. Determine the dimensions of the bucket 14 with which the sifter-sorter 12 will be used;
2. Cut metal pieces (appropriate for the dimensions of the bucket 14); e.g., using plasma cut or water jet or other material cutting tool;
3. Put the cut pieces into a fixture or set in such a fashion as to allow placement of the tines for attaching or welding;
4. Weld pieces into place to define the sifter-sorter 12; and
5. Paint the sifter-sorter 12.

FIGS. 12-15 show a sifter-sorter attachment 112 in accordance with alternative embodiments. The sifter-sorter attachment 112 is configured to be engaged by an existing bucket 114 of a loader vehicle or machine.

In various embodiments, the sifter-sorter attachment 112 is designed to be captured and lifted by a bucket of a vehicle. The sifter-sorter attachment 112 includes (see FIG. 12) a back end 127, proximate the bucket 114 when the bucket 114 captures the sifter-sorter attachment 112, in various embodiments. The sifter-sorter attachment 112 further includes a left side defined by a left end piece 136 (see FIG. 12) and a right side defined by a right end piece 138 (see FIG. 13), in various embodiments.

In various embodiments, the left and right end pieces 136 and 138 respectively include slots 122 aligned with one another for receiving a forward edge of the bucket, wherein the bucket can engage and lift the attachment using the slots 122.

The sifter-sorter attachment 112 further includes a front end 133, distal from the bucket 114 (see FIG. 13) in operation, in various embodiments. The sifter-sorter attachment 112 further includes a plurality of spaced apart tines 126 distributed between the left end piece 136 and right end piece 138, in various embodiments, which each have slots 122 aligned with the slots in the left and right end pieces 136 and 138. In the embodiments of FIGS. 12-15, contrary to the embodiments of FIGS. 1-11, each of the tines 126 has the same shape as the left end piece 136, which also has the same shape as the right end piece 138.

The slots 122 of the tines 126 and of the left end piece 136 and right end piece 138 each include an upper, downwardly facing surface 143 (see FIG. 14) that, in operation, face an inner surface of a bucket, and an opposed upwardly facing surface 145 that, in operation, faces an outer surface of the bucket.

In various embodiments, the sifter-sorter attachment 112 includes a lateral attachment bar or cross beam 135 (see FIG. 12) connected to the left end piece 138, tines 126, and right end piece 138.

The tines 126, left end piece 136, and right end piece 138 include respective lower surfaces 137 (see FIGS. 12-14), using which the sifter-sorter attachment 112 can rest on the ground or some other surface prior to being engaged by the bucket 114, in various embodiments. The lower surfaces 137 are rounded, in the illustrated embodiments, to allow the operator to control the amount of penetration into the soil by rolling forward, curling back, or adding down pressure (e.g., using the bucket).

The tines 126, left end piece 136, and right end piece 138 include respective upper surfaces 139 (FIG. 14) defining a curved material handling or holding area 116 in the general shape of a trough, to allow dirt to sift out the open bottom 118 (see FIG. 15) of the sifter-sorter 112 before the rest of the material progresses into the bucket 114.

In some embodiments, the material handling area 116 extends downwardly from the uppermost surface 141 of the tines 126, left end piece 136, and right end piece 138.

In some embodiments, the sorter-sifter attachment 112 is made of metal.

In various embodiments, the back ends 127 of the tines 126, left end piece 136, and right end piece 138 respectively include downwardly extending notches 147 in the upwardly facing surfaces 145. In various embodiments, the sorter-sifter attachment 112 further includes a cross bar 144, and the notches 147 receive and are connected to the cross bar 144.

In various embodiments, the back ends 127 of the left end piece 136, and right end piece 138 respectively include apertures 149 to pass a mechanism configured to secure the attachment to the bucket 114 such as is shown in the embodiment of FIG. 11 or otherwise using a chain, cable, rope, lanyard, or other mechanism.

In compliance with the patent statutes, the subject matter disclosed herein has been described in language more or less specific as to structural and methodical features. However, the scope of protection sought is to be limited only by the following claims, given their broadest possible interpretations. The claims are not to be limited by the specific features shown and described, as the description above only discloses example embodiments.

We claim:

1. A retrofit sifter-sorter attachment configured to be captured and lifted by a bucket of an existing vehicle from a position resting on the ground, the bucket having a mouth and a back, the attachment comprising:

a back end, proximate the bucket in operation;

a left side defined by a left end piece;

a right side defined by a right end piece;

the left and right end pieces including aligned slots cut therein for receiving a forward edge of the bucket, wherein the bucket can engage and lift the attachment using the slots;

a front end, distal from the bucket in operation;

a plurality of spaced apart tines distributed between the left end piece and right end piece;

a lateral attachment bar connected to the left end piece, tines, and right end piece;

the tines, left end piece, and right end piece including respective upper surfaces and including respective lower surfaces, with which the attachment can rest on the ground prior to being engaged by the bucket; the tines, left end piece, and right end piece including respective upper surfaces defining a curved material handling area in the general shape of a trough with upper surfaces lower than the upper surfaces of the tines, left end piece, and right end piece at the front end of the attachment when the attachment is resting on the ground, and the left end piece and right end piece having aligned apertures proximate the back end of the attachment;

a chain for securing the attachment to the bucket using the apertures; and a front cutting blade extending from the lower surface of the left end piece to the lower surface of the right end piece, at the front end of the attachment, and the cutting blade being attached to the left end piece, right end piece, and the tines.

2. A sifter-sorter attachment in accordance with claim 1 wherein the material handling area extends downwardly from the uppermost surface of the tines, left end piece, and right end piece.

3. A sifter-sorter attachment in accordance with claim 1 wherein the respective tines have the same shape as the right and left end pieces.

4. A sifter-sorter attachment in accordance with claim 1 wherein respective lower surfaces of the tines, left end piece, and right end piece can rest on the ground.

5. A sifter-sorter attachment in accordance with claim 1 wherein the tines, left side, and right side include a peak forward of the material handling area extending upwardly from the material handling area then down toward the lower surface, wherein material rolls up then down into the material handling area when the attachment moves forward and wherein material can be sifted between the tines.

6. A sifter-sorter attachment in accordance with claim 1 wherein the tines have slots aligned with the slots of the left end piece and right end piece.

7. A sifter-sorter attachment in accordance with claim 6 wherein the slots of respective tines include an upper, downwardly facing surface that, in operation, faces an inner surface of a bucket, and an opposed lower upwardly facing surface that, in operation, faces an outer surface of the bucket.

8. A sifter-sorter attachment in accordance with claim 7 wherein the tines respectively have back ends that include downwardly extending notches in the upwardly facing surfaces, the attachment further including a cross bar, wherein the notches receive and are connected to the cross bar.

9. An attachment configured to be captured and lifted by a bucket of a vehicle, the attachment comprising:

a back end proximate the bucket, in operation;

a left side defined by a left end piece including a vertical surface and including a lower surface;

a right side defined by a right end piece including a vertical surface and a lower surface;

a front end distal from the bucket, the front end defining a bottom surface;

slots cut in the vertical surfaces of the left end piece and right end piece, the slots each including an open back end, lower surface, upper surface spaced apart from, parallel to, and opposing the bottom surface, and a front surface extending downwardly and forwardly at an angle from the upper surface to the lower surface of each slot, the slots being aligned with each other to receive a forward edge of the bucket, wherein the bucket can engage and lift the attachment and wherein different sized buckets can be received in the slots and engage different locations along the angled front surfaces of the slots; and a plurality of spaced apart tines each having left and right major vertical surfaces facing the major vertical surface of another tine or facing the left end piece or the right end piece, the tines together defining a material handling area between the left side, right side, front end, and back end, the material handling area including apertures for sifting, wherein material rolls up into the material handling area when the attachment moves forward so that material can be sifted in the sifting area.

10. An attachment in accordance with claim 9 wherein the left side is defined by a left end piece in the general shape of a vertical rhombus and the right side is defined by a right end piece in the general shape of a vertical partial rhombus.

11. An attachment in accordance with claim 9 and further comprising slots cut in the vertical surfaces of the tines, the slots each including an open back end, lower surface, upper surface spaced apart from, parallel to, and opposing the bottom surface, and a front surface extending downwardly and forwardly at an angle from the upper surface to the lower surface of each slot, the slots being aligned with each other and with the slots of the left and right end pieces for receiving the forward edge of the bucket.

12. An attachment in accordance with claim 9 and shaped such that after sifting, remaining material can be rolled into the bucket.

13. An attachment in accordance with claim 9 and further comprising a plurality of spaced apart tines between the left end piece and the right end piece, the tines having upper surfaces defining, at least in part, the material handling area, the spaces between the tines defining, at least in part, the apertures for sifting.

14. An attachment in accordance with claim 9 wherein the front end is defined by a blade member extending from the left end piece to the right end piece, the blade further defining a bottom surface.

15. A material sifting method comprising:

providing a sifter-sorter attachment configured to be captured and lifted by a bucket of a vehicle, the attachment having a back end proximate the bucket, in operation; a left side; a right side; a front end distal from the bucket, the front end defining a bottom surface; a cutting bar extending across the bottom surface at the front end; slots for receiving a forward edge of the bucket; a material handling area between the left side, right side, front end, and back end, the material handling area including upper surfaces that are lower than upper surfaces at the front end of the attachment, and the material handling area including apertures for sifting; the method comprising:

engaging the front edge of a bucket of a front end loader into the slots of the sifter-sorter attachment;

moving the front end loader forward to scoop up material into the material handling area of the attachment, wherein material rolls up then down into the material handling area when the attachment moves forward; and lifting the bucket to lift the attachment, so that material can be sifted in the sifting area, with smaller material falling through the apertures and larger material remaining.

16. A method in accordance with claim 15 and further comprising, after the lifting, lowering the bucket to place the attachment on a surface and backing the front end loader away from the attachment to separate the attachment from the bucket.

17. A method in accordance with claim 15 wherein the attachment includes apertures near the back end, the method further comprising using the apertures to chain the attachment to the bucket.

18. A method in accordance with claim 15 and further comprising manufacturing the attachment by providing a left end piece, right end piece, cross beam, and a plurality of tines between the left end piece and right end piece, the manufacturing comprising:

determining the dimensions of the bucket with which the attachment will be used;

cutting metal to define the left end piece, right end piece, cross beam, and tines, appropriate for the dimensions of the bucket;

cutting the left end piece, right end piece, and tines to define the slots;

arranging and fixing the positions of the cut left end piece, right end piece, and tines in a fixture for arranging the spacing between the tines, left end piece, and right end piece; and welding the cross beam to the left end piece, right end piece, and plurality of tines to define the sifter-sorter.

* * * * *